US005299583A

United States Patent [19]

Lasch et al.

[11] Patent Number: 5,299,583

[45] Date of Patent: Apr. 5, 1994

[54] METHOD OF AND APPARATUS FOR SEPARATING FRAGMENTS OF TOBACCO RIBS FROM SHREDDED TOBACCO

[75] Inventors: Manfred Lasch, Hamburg; Reinhard Liebe, Bornsen; Klaus-Georg Hackmack, Hamburg, all of Fed. Rep. of Germany

[73] Assignee: Korber AG, Hamburg, Fed. Rep. of Germany

[21] Appl. No.: 993,312

[22] Filed: Dec. 18, 1992

[30] Foreign Application Priority Data

Dec. 21, 1991 [DE] Fed. Rep. of Germany ..... 4142631

[51] Int. Cl.[5] ..... A24B 3/06

[52] U.S. Cl. ..... 131/312; 131/302; 131/303; 131/304; 131/306

[58] Field of Search ..... 131/302, 303, 304, 306, 131/312, 299, 110

[56] References Cited

U.S. PATENT DOCUMENTS

| | | | |
|---|---|---|---|
| 3,985,145 | 10/1976 | Broscheit et al. | 131/303 |
| 4,004,594 | 1/1977 | Wochnowski et al. | 131/303 |
| 4,016,971 | 4/1977 | Komossa et al. . | |
| 4,116,203 | 9/1978 | Wochnowski et al. | 131/306 |
| 4,235,249 | 11/1980 | Psaras et al. . | |
| 4,401,205 | 8/1983 | Komossa et al. . | |
| 4,600,024 | 7/1986 | Edwards | 131/299 |
| 4,615,343 | 10/1986 | Komossa . | |
| 4,646,759 | 3/1987 | Thatcher et al. | 131/110 |
| 4,932,424 | 6/1990 | Liebe et al. | 131/304 |
| 5,025,813 | 6/1991 | Liebe et al. | 131/306 X |
| 5,099,863 | 3/1992 | Coleman | 131/312 |
| 5,161,548 | 11/1992 | Neville | 131/304 X |
| 5,199,448 | 4/1993 | Parker | 131/304 X |

*Primary Examiner*—Vincent Millin
*Assistant Examiner*—Raleigh W. Chiu
*Attorney, Agent, or Firm*—Darby & Darby

[57] ABSTRACT

A mixture of unsatisfactory fragments of tobacco ribs and shreds of tobacco leaf laminae and/or tobacco ribs which are bonded to each other and/or are clumped together and/or crimped is treated to loosen the coherent and/or clumped shreds and/or uncrimp individual shreds and to thereupon separate the fragments of ribs from the thus liberated and/or straightened shreds. The treatment involves heating the mixture with steam, thereafter cooling (if necessary) the mixture, and thereupon pneumatically separating the shreds from the fragments of tobacco ribs. The heating operation can take place simultaneously with moisturizing of the mixture and can be carried out in a rotary or vibratory conveyor.

48 Claims, 1 Drawing Sheet

106
118
119
111
117
109
107
50
48
52
47
46
4b
51
3
2
22
6
4
17
8
7
16
11
9
12
21
14
13
15
18
19
23
27
28
29
26
4a
44
36
37
43
45
39
38
41
40

METHOD OF AND APPARATUS FOR SEPARATING FRAGMENTS OF TOBACCO RIBS FROM SHREDDED TOBACCO

BACKGROUND OF THE INVENTION

The invention relates to improvements in methods of and in apparatus for treating mixtures of tobacco particles. More particularly, the invention relates to the treatment of mixtures containing a first fraction consisting of fragmentized tobacco ribs and a second fraction consisting of shredded tobacco ribs and/or tobacco leaf laminae.

Tobacco leaves which are to be converted into the fillers of cigarettes or other rod-shaped smokers' products are subjected to a number of treatments prior to entering the distributor (also called hopper) of a rod making machine, e.g., a cigarette maker. As a rule, the first step involves the destalking of tobacco leaves, i.e., separation of tobacco leaf laminae from tobacco ribs. The thus obtained laminae are largely devoid of ribs and are contacted by one or more flavoring agents (e.g., in the form of sauces) prior to introduction into a comminuting machine known as cutter. The ribs are largely devoid of leaf laminae and are thereupon treated separately from the laminae; such treatment involves shredding and the thus obtained shredded ribs are mixed with shredded tobacco leaf laminae. The resulting mixture of the two types of shreds is ready for introduction into the distributor or hopper of a cigarette maker.

Those parts of comminuted leaves which are obtained as a result of cutting of ribs upon separation of ribs from the leaf laminae often contain fragments having a relatively high specific gravity (weight/air resistance) and hence a relatively pronounced stiffness. Therefore, such portions of tobacco ribs (hereinafter called fragments in contrast to shreds) are likely to interfere with the making of satisfactory cigarettes or other rod-shaped smokers' articles, especially in modern cigarette makers which are designed to turn out up to and in excess of 10,000 articles per minute. Consequently, the fragments of ribs should be, and normally are, separated from satisfactory comminuted ribs (namely acceptable shredded ribs) as well as from shredded leaf laminae. In many instances, the relatively heavy fragments are separated from shreds (of ribs and leaf laminae) in a cigarette making machine proper. The reason is that, in order to make a satisfactory tobacco filler, it is necessary to form a stream of loose tobacco particles (shreds) and, since the fragments are heavier than the shreds, the separating step can be carried out by resorting to relatively simple and convenient pneumatic separation or classification. Such pneumatic separation or classification involves the entrainment of the relatively lightweight shreds by one or more streams of a gaseous carrier fluid which is incapable of entraining the heavier fragments of tobacco ribs.

A drawback of heretofore known procedures of separating fragments of tobacco ribs from the shreds is that the mixture of fragments and shreds also contains a rather high percentage of shredded leaf laminae and/or ribs which, however, are present in such formations that they behave (for example, in a gaseous carrier fluid) not unlike undesirable fragments of tobacco ribs. The formations include coherent shreds, clumps of interlaced shreds and/or crimped or crimpled shreds whose configuration and/or other characteristics are such that they cannot be readily separated from undesirable fragments of tobacco ribs. For example, tobacco which has been treated with relatively high quantities of one or more flavoring agents in the form of sauces or the like will yield satisfactory shreds many of which, however, are bonded to each other by one or more flavoring agents to constitute relatively large accumulations having a relatively high specific weight. Furthermore, the presence of one or more flavoring agents enhances the tendency of otherwise satisfactory shreds to become interlaced and to form clumps which behave not unlike accumulations of coherent (bonded-together) shreds. Still further, the addition of one or more sticky flavoring agents enhances the tendency of individual shreds (or two or another small number of shreds) to undergo a pronounced crimping action and to be thus converted into globules or like configurations which, too, cannot be readily segregated from unsatisfactory or unacceptable fragments of tobacco ribs.

On the other hand, and since tobacco constitutes by far the most expensive constituent of a rod-shaped smokers' product, it is desirable for reasons of economy to salvage as many shredded tobacco particles as possible, i.e., to separate from unacceptable fragments of tobacco ribs all those shreds or groups of shreds (be it shreds of leaf laminae or shreds of ribs) which would be acceptable for use in the making of tobacco fillers save for their tendency to adhere to each other as a result of bonding or interlacing or to assume configurations departing from those of the majority of shreds, e.g., because portions of each such individual shred are bonded to each other by a flavoring agent.

OBJECTS OF THE INVENTION

An object of the invention is to provide a novel and improved method of recovering, for use in the making of cigarettes or for analogous purposes, all those particles of comminuted tobacco leaves which would be acceptable save for their tendency to be clumped with and/or bonded to neighboring acceptable particles and/or which would be acceptable but for their tendency to crimp or crimple and to thus constitute particles not readily separable from the undesirable fragments of ribs.

Another object of the invention is to provide a novel and improved method of treating so-called winnower tobacco.

A further object of the invention is to provide a method of salvaging tobacco shreds which, in the absence of any undertaking to the contrary, would be unsuitable for conversion into the fillers of cigarettes or other rod-shaped smokers' products.

An additional object of the invention is to provide a novel and improved method of segregating useless or undesirable fragments of tobacco ribs from all other parts of comminuted tobacco leaves.

Still another object of the invention is to provide a novel and improved method of destroying the bonds between coherent shreds of tobacco leaf laminae and/or tobacco ribs.

A further object of the invention is to provide a novel and improved method of straightening crimped tobacco shreds and a novel and improved method of separating coherent portions of discrete shreds from one another.

Another object of the invention is to provide a novel and improved method of varying the moisture content of tobacco simultaneously with other treatment or treatments of particles of tobacco leaves.

An additional object of the invention is to provide a novel and improved method of recovering or converting a high percentage of so-called winnower tobacco for use in smokers' products.

Still another object of the invention is to provide a novel and improved apparatus for the practice of the above outlined method.

A further object of the invention is to provide a novel and improved apparatus for treating so-called winnower tobacco.

Another object of the invention is to provide a rod making machine, such as a cigarette maker, which embodies an apparatus of the above outlined character.

An additional object of the invention is to provide the apparatus with novel and improved means for treating that fraction of a mixture of tobacco particles which consists of or includes coherent (bonded together) shreds of tobacco leaf laminae and/or tobacco ribs, clumped (e.g., interlaced but not necessarily bonded together) shreds of tobacco leaf laminae and/or tobacco ribs, and/or crimped individual shreds of tobacco leaf laminae and/or tobacco ribs.

Still another object of the invention is to provide an apparatus which can simultaneously subject tobacco shreds to a number of different treatments such as heating, moisturizing, transporting, straightening and classification.

A further object of the invention is to provide the apparatus with novel and improved means for treating winnower tobacco in a small area and without the need for spreading the mixture of unacceptable fragments of tobacco ribs in the form of a carpet or stream.

Another object of the invention is to provide an apparatus which can recover all or nearly all valuable particles of tobacco leaves for the making of cigarettes or other rod-shaped smokers' products.

An additional object of the invention is to provide the apparatus with novel and improved means for varying the moisture content of comminuted tobacco leaves.

Still another object of the invention is to provide the apparatus with novel and improved means for regulating the temperature of tobacco particles simultaneously with at least one other treatment.

A further object of the invention is to provide smokers' products containing tobacco particles which are treated in accordance with the above outlined method and/or in the above outlined apparatus.

SUMMARY OF THE INVENTION

One feature of the present invention resides in the provision of a method of treating a mixture which is composed of a first fraction consisting primarily (e.g., exclusively) of fragments of tobacco ribs and a second fraction consisting primarily (e.g., exclusively) of shreds of tobacco ribs and tobacco leaf laminae and including coherent (such as bonded together), clumped together and/or crimped shreds. The improved method comprises the steps of heating the mixture to thus at least substantially loosen the coherent and/or clumped together shreds and/or to uncrimp (e.g., at least partially straighten) the crimped shreds, and thereupon separating the fractions from each other. The heating step can comprise, and preferably comprises, contacting the mixture with steam.

The heating step can include raising the moisture content of the mixture; the initial moisture content of the mixture can be in the range of 11–14 percent, preferably 12–13 percent. The step of raising the moisture content can include adding moisture to raise the moisture content from the initial or first moisture content (normally between 11–14 percent) to a second moisture content exceeding the first moisture content by 2–10 percent. In many instances, it suffices to raise the initial moisture content (e.g., of between 12 and 13 percent) by 3–4 percent or by 5–6 percent.

The steam is preferably hot steam (such as superheated or saturated steam) which is caused to contact the mixture in order to raise the temperature of the mixture (e.g., from room temperature) to between 70° and 115° C., particularly to between 95° and 105° C.

The heating step can include advancing the mixture in a vibratory conveyor (e.g., in a closed tunnel shaped vibratory conveyor) and contacting the mixture with steam including directing a plurality of jets of steam through a foraminous bottom of the vibratory conveyor. Alternatively, the heating step can include advancing the mixture in a rotary drum-shaped conveyor and contacting the mixture with steam in the drum-shaped conveyor.

The heating step can include contacting the mixture with pressurized steam, and such heating step can further include agitating the mixture with pressurized steam. The steam can be maintained at a pressure of at least 5 bar, preferably approximately, 10 bar or more.

The separating step can include pneumatically classifying the mixture. The fragments of tobacco ribs have a first specific weight and the shreds have a lower second specific weight; this renders it possible to resort to a pneumatic classifying step, e.g., a step which involves directing against the mixture at least one stream of a gaseous carrier fluid which can entrain the shreds but not the fragments of tobacco ribs. Such method can further comprise the step of heating the gaseous carrier fluid (e.g., air).

Still further, the improved method can comprise the step of cooling the mixture following the heating step and prior to the separating step. The cooling step can include transporting the mixture along a predetermined path, e.g., with an open vibratory conveyor. If the heating step includes heating the mixture from a first value (e.g., from room temperature) to a second value (e.g., to a temperature of between 70° and 115° C.), the cooling step can comprise lowering the temperature of the heated mixture at least close to the first value.

Another feature of the present invention resides in the provision of an apparatus for treating a mixture which is composed of a first fraction consisting primarily (e.g., exclusively) of fragments of tobacco ribs and a second fraction consisting primarily (e.g., exclusively) of shreds of tobacco ribs and/or tobacco leaf laminae and including coherent, clumped together and/or crimped shreds. The improved apparatus comprises means for heating the mixture to thus at least substantially loosen and/or uncrimp (e.g., at least partially straighten) the coherent, clumped together and/or crimped shreds, and means for thereafter separating the two fractions from each other. In accordance with a presently preferred embodiment, the heating means includes a source of steam (e.g., superheated or saturated steam) and means for contacting the mixture with steam. The contacting means can include means for agitating the mixture.

If the mixture has an initial or first moisture content of 11–14 percent (particularly 12–13 percent), the heating means can include means for raising the moisture content of the mixture, i.e., means for adding moisture to the constituents of the mixture. The heating means can be designed to raise the initial moisture content by 2–10 percent, e.g., by 3–4 or 5–6 percent from 12–13 percent.

The source of steam can be controlled or regulated and the contacting means can be operated in such a way that the temperature of the mixture is raised from a first value (e.g., room temperature) to a second value of preferably between 70° and 115° C., particularly between 95° and 105° C.

If the source contains hot steam, the contacting means can comprise a closed tunnel-shaped vibratory conveyor for the mixture. Such conveyor can be provided with a permeable bottom and the heating means can further comprise means for supplying hot steam from the source into the conveyor through the permeable bottom. The bottom can be provided with orifices for admission into the conveyor of numerous jets of steam which can perform the additional function of agitating the mixture in the conveyor. Such agitation enhances the heating action and contributes to loosening and/or uncrimping of the shreds.

Alternatively, the contacting means can comprise a rotary drum-shaped conveyor for the mixture and means for supplying hot steam from the source into the conveyor. The supplying means can include a conduit which extends from the source into the conveyor and has in the conveyor orifices to discharge jets of hot steam whereby such jets agitate the mixture in the conveyor.

The heating means can comprise a source of pressurized steam and means for contacting the mixture with pressurized steam. The source can include means for maintaining the steam at a pressure of approximately 10 bar or more.

The separating means can comprise a pneumatic classifier. Since the specific weight of fragments of tobacco ribs is higher than the specific weight of the shreds, the classifier can comprise means for directing against the mixture at least one stream of a gaseous carrier fluid to entrain the shreds but not the fragments which constitute the first fraction. One of the presently preferred gaseous carrier fluids is hot air.

The apparatus can further comprise means for transporting the mixture from the heating means to the separating means. The transporting means can include means for cooling the mixture on its way to the separating means; such cooling means can constitute or include an open vibratory conveyor.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawings.

DESCRIPTION OF PREFERRED EMBODIMENTS

Figures 1, 2:
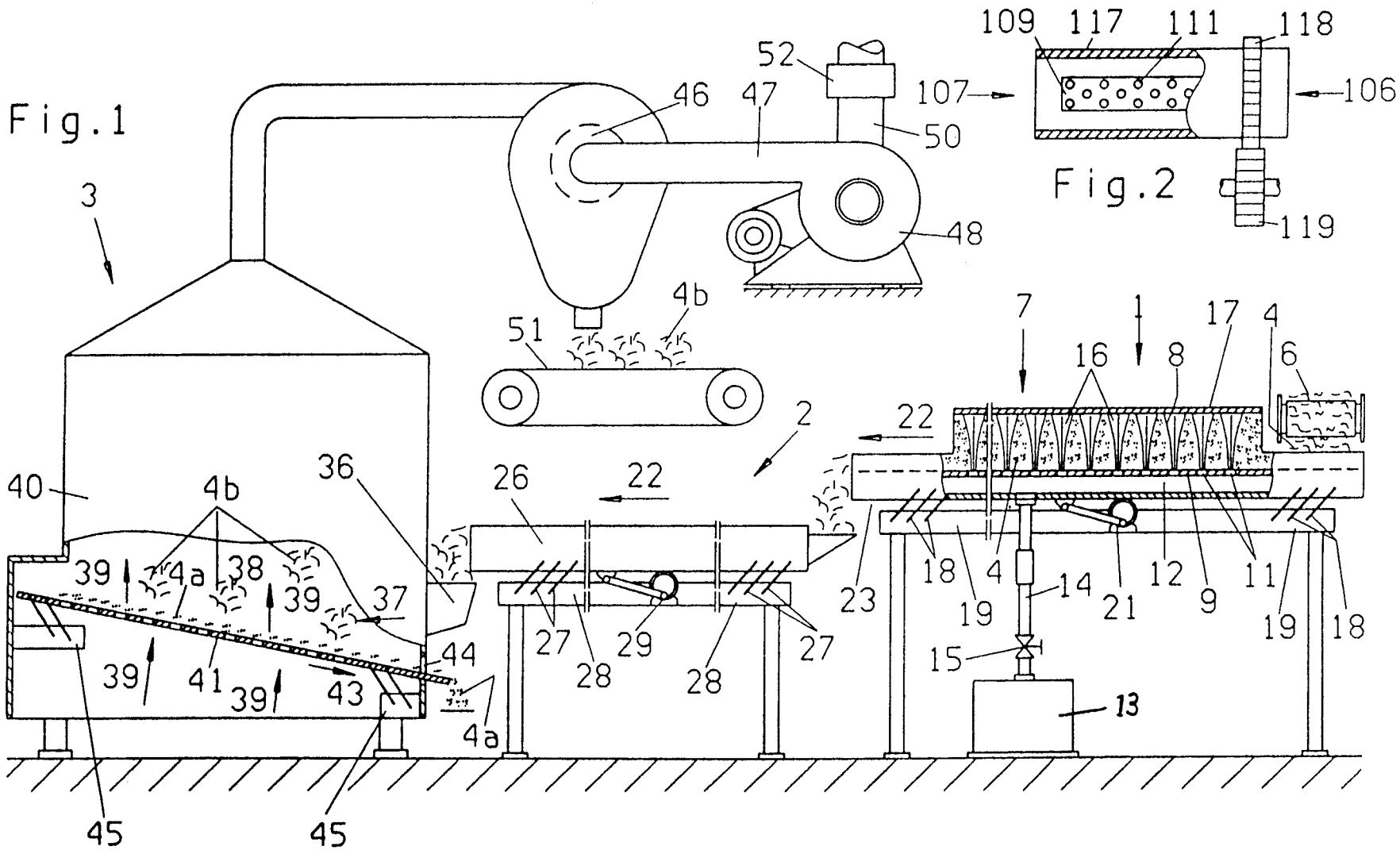
FIG. 1 is a schematic partly elevational and partly vertical sectional view of an apparatus which embodies one form of the invention and wherein the heating means includes a closed tunnel-shaped vibratory conveyor.
FIG. 2 is a fragmentary schematic partly elevational and partly sectional view of a portion of modified heating means wherein the mixture is heated in the interior of a rotary drum-shaped conveyor.

Referring first to FIG. 1, there is shown an apparatus which embodies one form of the present invention and comprises three main assemblies, namely a heating unit 1, a combined transporting and cooling unit 2, and a separating or classifying unit 3. The reference character 6 denotes a belt conveyor which serves to deliver to the heating unit 1 a continuous or interrupted stream of a mixture 4 including a first fraction 4*a* and a second fraction 4*b*. The fraction 4*a* consists of unacceptable or less desirable fragments of tobacco ribs which are rather stiff and heavy and are likely to affect the appearance and/or other characteristics of cigarettes or other rod-shaped articles as well as to interfere with optimum operation of a rod making machine. Therefore, it is desirable to separate or segregate the fraction 4*a* from the second fraction 4*b* which latter consists of acceptable shreds of tobacco ribs and/or tobacco leaf laminae but in such formations and/or accumulations which prevent reliable and accurate separation from the fragments of ribs which constitute the fraction 4*a*. For example, the constituents of the fraction 4*b* can include (a) groups of coherent shreds which are bonded together by one or more sticky flavoring agents (such as various sauces), (b) agglomerations of clumped together shreds which are not or need not be actually bonded to each other but are sufficiently interlaced to assume shapes which prevent ready separation of such clumps from the fragments of the fraction 4*a*, and/or (c) discrete shreds which are crimped into balls or like formations, e.g., because their own portions are bonded together by a flavoring agent. The mixture 4 contains randomly distributed constituents of the fractions 4*a* and 4*b*, and the purpose of the heating unit 1 is to treat the constituents of the fraction 4*b* so that their (coherent and/or clumped) shreds become separated or can be separated from each other and their crimped individual shreds become straightened and/or otherwise alter their shape to an extent which is necessary to permit reliable and simple separation from the fragments of the fraction 4*a*. The mixture 4 normally also contains a relatively small percentage of satisfactory shreds of tobacco ribs and/or tobacco leaf laminae which happen to be entrained with the constituents of the fractions 4*a*, 4*b* and whose separation from the fraction 4*a* presents no problems. Such satisfactory shreds are much lighter than the fragments of the fraction 4*a* and/or the untreated constituents of the fraction 4*b* and could be readily separated from the fractions 4*a*, 4*b* in a pneumatic classifying unit. However, it is presently preferred to treat the satisfactory shreds with the fraction 4*b* and to thereupon separate all shreds (including those which were forming part of the untreated fraction 4*b*) when the treatment of the fraction 4*b* is completed. The percentage of the fraction 4*b* in the mixture which is supplied by the conveyor 6 is normally much higher than the percentage of the fraction 4*a*, and the percentage of the fraction 4*a* is or can be much higher than the percentage of satisfactory lightweight shreds in the untreated mixture 4.

The heating unit 1 comprises an elongated tunnel-shaped vibratory tobacco contacting and advancing conveyor 7 having an inlet for reception of mixture 4 from the conveyor 6 and an elongated passage 8 surrounded by a tunnel-shaped housing 17 having a permeable bottom 9 and an outlet 23 for the fragments and shreds of the heated mixture 4. The bottom 9 of the housing 17 has orifices of ports 11 for jets 16 of pressurized hot steam issuing from an elongated steam chamber or box 12 located beneath the bottom 9 and forming part of the means for supplying steam from a source 13, e.g., a conventional steam generator of any known design. The means for supplying hot steam to the passage 8 of the vibratory conveyor 7 further comprises an at least partially flexible (particularly elastic) conduit 14 which is equipped with a combined shutoff and regulating valve 15. The orifices 11 can constitute suitably distributed holes or bores in the bottom 9, and the pressure of steam in the chamber 12 is sufficiently high (e.g., 10 bar or more) to ensure that the jets 16 are capable of agitating and intermixing the constituents of the mixture 4 in the passage 8 while such mixture advances from the discharge end of the conveyor 6 toward and beyond the outlet 23 in the direction indicated by arrow 22. Agitation of the mixture 4 by the jets 16 ensures rapid, pronounced and uniform heating of the intermixed fractions 4a and 4b to a desired temperature, e.g. from room temperature to a temperature in the range of 70°–115° C., preferably 95°–105° C.

The steam which forms the jets 16 entering the passage 8 of the conveyor 7 preferably also serves to raise the moisture content of the mixture 4 between the discharge end of the conveyor 6 and the outlet 23, e.g., from an initial moisture content of 11–14 percent (preferably 12–13 percent for use of the shreds in the making of cigarettes) to a higher second moisture content. For example, the jets 16 can raise the initial moisture content by as little as 2 percent or by as much as 10 percent, normally 3–4 or 5–6 percent.

The means for vibrating or agitating the housing 17 of the conveyor 7 includes a stationary frame 19, sets of leaf springs 18 which couple the housing 17 to the frame 19, and an eccentric drive 21 and/or other suitable means for moving the housing 17 relative to the frame 19. The nature of vibrations of the housing 17 is selected in such a way that the mixture 4 advances in the passage 8 from the conveyor 6 toward and beyond the outlet 23 at a desired (optimum) rate.

If the moisture content of the mixture 4 which is treated in the passage 8 of the conveyor 7 should remain substantially unchanged, the steam generator 13 is designed or adjusted to supply dry hot steam which merely serves to heat the fractions 4a and 4b to a desired optimum temperature which ensures full or at least adequate separation of coherent and/or clumped together shreds as well as unraveling or straightening or other corrections in the configuration of the originally crimped individual shreds so that all of the shreds can be readily separated from the fragments of the fraction 4a downstream of the conveyor 7. Thus, if the initial moisture content of shreds forming the fraction 4b is satisfactory for further processing of such shreds into the filler of a cigarette rod, the moisturizing action of steam forming the jets 16 will be minimal, negligible or nil. If the initial moisture content of shreds forming part of or constituting the fraction 4b is 12–13 percent and the optimum moisture content of shreds in the filler is 15–16 percent, the wetting or moisturizing action of steam will amount to approximately 3 percent.

If the moisture percent of treated shreds is to be higher, e.g., in order to enhance the quality of the ultimate products, the steam generator 13 can be set or adjusted to supply saturated steam which can raise the moisture content of shreds forming part of the fraction 4b from approximately 12–13 percent by as much as 5–6 percent. If the moisture content is to be increased beyond that which can be achieved with steam alone, the heating unit 1 can be designed to deliver into the passage finely distributed minute particles of hot water or another liquid by resorting to any suitable spraying device, not shown.

The heating unit 1 can be designed to increase the moisture content of shreds by as much as 10 percent, e.g., from an initial moisture content of 12–13 percent. It is also possible to vary or regulate the moisturizing action, for example, depending on the ratio of fractions 4a, 4b in the mixture 4 which is supplied by the conveyor 6 and/or for other reasons.

As already mentioned hereinbefore, the steam generator 13 is preferably designed to supply steam at an elevated pressure; this ensures highly satisfactory agitation and intermixing as well as uniform and rapid heating of the constituents of the mixture 4 and renders it possible to reduce the dimensions of the heating unit 1 and of the entire apparatus. It has been found that the operation of the unit 1 is quite satisfactory if the pressure of steam issuing from the source 13 is not less than 5 bar. It was also found that the operation of the unit 1 is even more satisfactory if the steam pressure exceeds 5 bar and is preferably close to or even above 10 bar.

The heating action of the unit 1 upon the constituents of the mixture 4 can be varied by appropriate selection of the temperature and other parameters of steam as well as by appropriate selection of the length of the passage 8 and/or of the rate of advancement of the mixture 4 from the conveyor 6 toward the outlet 23. As mentioned above, the presently preferred temperature range of particles leaving the conveyor 7 is between 70° and 115° C., most preferably 95° to 105° C.

Heating and, if necessary, moisturizing of particles forming the mixture 4 in the passage 8 of the conveyor 7 results in rapid, complete or nearly complete and reliable separation of coherent or clumped together shreds of the fraction 4b as well as in predictable reshaping of crimped individual shreds so that all of these shreds are ready to be separated from the fragments of the fraction 4a in a simple and time-saving manner. Intensive agitation of the mixture 4 by the jets 16 in the passage 8 also contributes to more reliable separation of coherent and/or clumped together shreds as well as in desirable changes of shape of the crimped individual shreds not later than upon arrival at the outlet 23.

The transporting unit 2 comprises an open vibratory conveyor having a trough 26 mounted on leaf springs 27 which are attached to a fixed frame 28. An eccentric drive 29 is provided to repeatedly move the trough 26 relative to the frame 28 and to thus advance the heated mixture 4 from the outlet 23 (in the direction of arrow 22) toward and into the separating or classifying unit 3. A rotary cell wheel gate of customary design is provided in the inlet 36 of a housing 40 forming part of the unit 3 and defining a classifying chamber 38 wherein the shreds of the fraction 4b are separated from the fragments of the fraction 4a. The constituents of the mixture 4 are cooled by air (and/or otherwise) during advancement in the trough 26 of the transporting unit 2 so that their temperature can be reduced, e.g., back to that of the mixture 4 on the conveyor 6.

The chamber 38 is bounded from below by a downwardly and rearwardly sloping sieve 41 which defines a plurality of paths for the flow of ascending streams 39 of a gaseous carrier fluid (for example, hot air) serving to segregate the fraction 4b from the fraction 4a. The fractions 4a, 4b are admitted into the chamber 38 in the direction of arrow 37, and the fraction 4a slides along the upper side of the sieve 41 in the direction of arrow 43 to be evacuated from the chamber 38 through a first outlet 44. The source of hot air flowing in the chamber 38 in the direction of arrows 39 is or can be the outlet of a fan 48 or any other suitable source. The sieve 41 is vibrated at 45 to promote the advancement of segregated fraction 4a toward and through the outlet 44 of the housing 40.

The streams 39 of hot air entrain the shreds of the fraction 4b, as well as any other satisfactory shreds which were contained in the mixture 4 on the conveyor 6, through a second outlet of the housing 40 and into a separator 46 wherein the fraction 4b is separated from the gaseous carrier fluid. The latter is drawn through a conduit 47 into the intake of the fan 48. A cell wheel gate (not specifically shown) in the separator 46 discharges the fraction 4b onto the upper reach of an evacuating conveyor 51 which can serve to advance the shreds into storage, into the distributor or hopper of a cigarette rod making machine or to another destination.

The fraction 4b is segregated from the fraction 4a by streams 39 of a heated gaseous carrier fluid if the temperature of the fraction 4b is too high for immediate processing upon transfer onto the evacuating conveyor 51. The reference numeral 50 denotes a conduit which contains a suitable heater 52 and serves to convey air from the outlet of the fan 48 into the housing 40 of the separating unit 3 at a level below the sieve 41.

The classifying or separating unit 3 can be modified in a number of ways without departing from the spirit of the invention. All that counts is to bring about a relative movement between the gaseous carrier fluid and the fragments of the fraction 4a so as to separate the shreds of the fraction 4b from the fraction 4a. For example, the segregation can take place in a body of stagnant air by resorting to a winnower or an analogous device which can propel the fragments of the fraction 4a and the shreds of the treated fraction 4b in such a way that the trajectories of the fragments differ from those of the shreds, i.e., that the shreds are effectively segregated from the fragments. The illustrated unit 3 is designed to deliver the mixture 4 from the trough 26 of the transporting unit 2 into ascending streams 39 of a gaseous carrier medium (normally hot air). It is further possible to employ a winnower or an analogous device which propels the constituents of the mixture 4 into the chamber 40, i.e., into a number of ascending streams 39 of a gaseous carrier fluid. Hot air is preferred at this time if the moisture content of the shreds forming part of the fraction 4b is to be reduced before the shreds reach the evacuating conveyor 51.

An important advantage of the improved method and apparatus is that a very high percentage of valuable material (fraction 4b of the mixture 4) is recovered for use in the making of cigarettes or other smokers' products. Moreover, the treatment and recovery of shreds forming the fraction 4b are simple and can be completed in a small area by resorting to a simple apparatus.

Another important advantage of the improved method and apparatus is that the treatment of fraction 4b can be regulated with a high degree of precision so as to ensure the recovery of a high percentage (e.g., 100 percent) of shreds which constitute the fraction 4b of the untreated mixture 4. All that is necessary is to properly regulate the treatment in the heating unit 1 so as to ensure that the shreds which reach the chamber 38 in the housing 40 of the classifying unit 3 can be readily separated from the fragments of the fraction 4a.

A further important advantage of the improved method and apparatus is that the treatment in the unit 1 can involve heating as well as other modes of influencing the shreds in the fraction 4b. Thus, the jets 16 of steam can serve to effect a separation of coherent shreds and/or changes in configuration of crimped individual shreds as well as a change of the moisture content. If the moisture content cannot be raised by steam alone, the unit 1 can be equipped with one or more devices which inject into the passage 8 one or more sprays of hot water or any other suitable liquid, e.g., if the moisture 25 content of the shreds is to be raised by up to 10 percent. It is also within the purview of the invention to change the moisture content of shreds in the passage 8 in two or more successive stages, e.g., first with steam and thereupon with sprays of hot water or vice versa.

The treatment in the unit 1 can involve a relatively small increase of the moisture content (e.g., by 3–4 percent from an initial or first moisture content of 12–13 percent) if the moisture content of shreds on the evacuating conveyor 51 need not exceed or should only slightly exceed the initial moisture content. Tobacco shreds which are to be admitted into a cigarette maker are normally treated to have a moisture content of approximately 13 percent. Separation of shreds forming the fraction 4b of the mixture 4 which is admitted into the conveyor 7 of the unit 1 is highly satisfactory if the moisture content of the fraction 4b is increased by 3–4 percent from an initial moisture content of 12–13 percent. If the initial moisture content of shreds in the fraction 4b is higher or lower than 12–13 percent, the moisturizing action in the passage 8 is reduced or intensified accordingly; this will ensure that the final moisture content of shreds on the evacuating conveyor 51 will match or approximate the desired optimal moisture content, normally approximately 13 percent.

Saturated steam will be used if the moisture content of the shreds is to be raised well above the initial moisture content, and hot steam will be used if the moisture content is to be raised only slightly, e.g., by 2–6 percent.

The utilization of steam under pressure of 5 bar or more is desirable because this promotes the heating and moisturizing action in the passage 8 and contributes to more uniform treatment of the fraction 4b. As already mentioned above satisfactory results were obtained with steam at a pressure of 10 bar or more.

The temperature of the heated fraction 4b should be as high as possible without unduly affecting the flavor and/or other desirable characteristics of the tobacco filler which contains the processed shreds of the fraction 4b. It has been found that the aforementioned range of 70°–115° C. is quite satisfactory to ensure adequate treatment of the fraction 4b without unduly affecting the desirable characteristics of the shreds which are delivered onto the evacuating conveyor 51. The presently preferred temperature range is 95°–105° C., especially close to approximately 100° C.

FIG. 2 shows a portion of a modified heating unit wherein the vibratory conveyor 7 is replaced with a rotary drum-shaped conveyor 107. The means for rotating this conveyor 107 about a substantially horizontal or a slightly inclined axis can include a first gear 118 on the tubular housing 117 of the conveyor and a driver gear 119 meshing with the gear 118. The housing 117 rotates around a conduit 109 which is provided with orifices 111 or other suitable outlets for jets of pressurized steam. Such jets heat, moisturize (if necessary) and agitate the constituents of a mixture which is delivered in the direction of arrow 106. The source of steam (not shown) can include a suitable adjustable steam generator.

U.S. Pat. No. 4,235,249 granted Nov. 25, 1980 to Psaras et al. for "Method and apparatus for producing expanded tobacco from whole tobacco stems" discloses another mode of contacting tobacco particles with steam during transport of such particles through a suitable drum-shaped conveyor. The disclosure of this patent is incorporated herein by reference As used herein, the term "shreds" is intended to embrace, among others, particles known as "cut" or "cut tobacco"; such particles can be obtained by comminuting tobacco leaf laminae and/or tobacco ribs in machines of the type disclosed, for example, in commonly owned U.S. Pat. No. 4,615,343 (granted Oct. 7, 1986 to Komossa), in commonly owned U.S. Pat. No. 4,401,205 (granted Aug. 30, 1983 to Komossa et al.) and in commonly owned U.S. Pat. No. 4,016,971 (granted Apr. 12, 1977 to Komossa et al.).

As used herein, the term "fragments" is intended to denote, among others, those particles which can be obtained by comminuting tobacco ribs in machines employing so-called shredding rolls.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A method of treating a mixture which is composed of a first fraction consisting primarily of fragments of tobacco ribs and a second fraction consisting primarily of shreds of tobacco ribs and tobacco leaf laminae and including coherent, clumped together and/or crimped shreds, comprising the steps of heating the mixture, including contacting the mixture with steam, to thus at least substantially loosen and/or uncrimp the coherent, clumped together and/or crimped shreds; and thereupon separating the fractions from each other.

2. The method of claim 1 of treating a mixture having a moisture content of 11–14 percent, wherein said heating step includes raising the moisture content of the mixture.

3. The method of claim 1 of treating a mixture having a moisture content of 12–13 percent, wherein said heating step includes raising the moisture content of the mixture.

4. The method of claim 1 of treating a mixture having a first moisture content, wherein said heating step includes adding moisture to the fractions so that the heated mixture has a second moisture content higher than said first moisture content.

5. The method of claim 4, wherein said step of adding moisture includes raising the moisture content of the mixture by 2–10 percent.

6. The method of claim 5, wherein the first moisture content is between 11 and 14 percent.

7. The method of claim 4, wherein the first moisture content is between 12 and 13 percent and said step of adding moisture includes said step of contacting the mixture with steam to raise the moisture content by 3–4 percent.

8. The method of claim 4, wherein the first moisture content is between 12, and 13 percent and said step of adding moisture includes said step of contacting the mixture with steam to raise the moisture content by 5–6 percent.

9. The method of claim 1, wherein said heating step includes raising the temperature of the mixture to between 70° and 115° C.

10. The method of claim 1, wherein said heating step includes raising the temperature of the mixture to between 95° and 105° C.

11. The method of claim 1, wherein said heating step comprises advancing the mixture in a vibratory conveyor and said step of contacting the mixture with steam includes directing against the mixture a plurality of jets of steam through a foraminous bottom of the conveyor.

12. The method of claim 1, wherein said heating step includes advancing the mixture in a drum-shaped conveyor and said step of contacting the mixture with steam takes place in the drum-shaped conveyor.

13. The method of claim 1, wherein said steam is saturated steam.

14. The method of claim 1, wherein said steam is heating step comprises contacting the mixture with superheated steam.

15. The method of claim 1, wherein said steam is heating step comprises contacting the mixture with pressurized steam.

16. The method of claim 15, wherein said heating step further comprises agitating the mixture with pressurized steam.

17. The method of claim 1, wherein said steam is at a pressure of at least 10 bar.

18. The method of claim 1, wherein said separating step comprises pneumatically classifying the mixture.

19. The method of claim 18 of treating a mixture wherein the fragments of tobacco ribs have a first specific weight and the shreds have a lower second specific weight, wherein said classifying step includes directing against the mixture at least one stream of a gaseous carrier fluid to entrain the shreds.

20. The method of claim 19, further comprising the step of heating the carrier fluid.

21. The method of claim 1, further comprising the step of cooling the mixture following said heating step and prior to said separating step.

22. The method of claim 21, wherein said cooling step includes transporting the mixture along a predetermined path.

23. The method of claim 22, wherein said heating step comprises raising the temperature of the mixture from a first value to a second value and said cooling step comprises lowering the temperature of the heated mixture at least close to said first value.

24. The method of claim 22, wherein said transporting step includes advancing the mixture along said path in a vibratory conveyor.

25. Apparatus for treating a mixture which is composed of a first fraction consisting primarily of fragments of tobacco ribs and a second fraction consisting primarily of shreds of tobacco ribs and tobacco leaf laminae and including coherent, clumped together and/or crimped shreds, comprising means for heating the mixture of thus at least substantially loosen and/or uncrimp the coherent, clumped together and/or crimped shreds, said heating means including a source of steam and means for contacting the mixture with steam; and means for thereafter separating the fractions from each other.

26. The apparatus of claim 25, wherein said contacting means includes means for agitating the mixture.

27. The apparatus of claim 25 for treating a mixture having a moisture content of 11 to 14 percent, wherein said heating means comprises means for raising the moisture content of the mixture.

28. The apparatus of claim 25 for treating a mixture having a moisture content of 12 to 13 percent, wherein said heating means comprises means for raising the moisture content of the mixture.

29. The apparatus of claim 25 for treating a mixture having a first moisture content, wherein said heating means comprises means for adding moisture to the mixture so that the heated mixture has a second moisture content higher than the first moisture content.

30. The apparatus of claim 29, wherein the means for adding moisture includes means for raising the first moisture content by 2–10 percent.

31. The apparatus of claim 29, wherein the first moisture content is between 12 and 13 percent and the means for adding moisture includes means for raising the first moisture content by 3–4 percent.

32. The apparatus of claim 29, wherein the first moisture content is between 12 and 13 percent and the means for adding moisture includes means for raising the first moisture content by 5–6 percent.

33. The apparatus of claim 25, wherein said source contain hot steam and said means for contacting the mixture with hot steam is arranged to raise the temperature of the mixture to between 70° and 115° C.

34. The apparatus of claim 25, wherein said source contains hot steam and said means for contacting the mixture with hot steam is arranged to raise the temperature of the mixture to between 95° and 105° C.

35. The apparatus of claim 25, wherein said source contains hot steam and said heating means further comprises a closed tunnel-shaped vibratory conveyor for the mixture, said conveyor having a permeable bottom and said contacting means comprising means for supplying hot steam from said source into said conveyor through said permeable bottom.

36. The apparatus of claim 35, wherein said bottom has orifices for admission into the conveyor of jets of steam which agitate the mixture in said conveyor.

37. The apparatus of claim 25, wherein said source contains hot steam and said heating means further comprises a rotary drum-shaped conveyor for the mixture, said contacting means including means for supplying hot steam from said source into said conveyor.

38. The apparatus of claim 37, wherein said supplying means comprises a conduit extending from said source into said conveyor and having in said conveyor orifices to discharge jets of hot steam which agitate the mixture in said conveyor.

39. The apparatus of claim 25 wherein source contains saturated steam.

40. The apparatus of claim 25, wherein said source contains superheated steam.

41. The apparatus of claim 25, wherein said source contains pressurized steam.

42. The apparatus of claim 41, wherein said source includes means for maintaining the pressure of steam at or above approximately 10 bar.

43. The apparatus of claim 25, wherein said separating means includes a pneumatic classifier.

44. The apparatus of claim 43 for treating a mixture wherein the fragments of tobacco ribs have a first specific weight and the shreds have a lower second specific weight, wherein said classifier comprises means for directing against the mixture at least one stream of a gaseous carrier fluid to entrain the shreds.

45. The apparatus of claim 44, wherein the carrier fluid is hot air.

46. The apparatus of claim 25, further comprising means for transporting the mixture from said heating means to said separating means.

47. The apparatus of claim 46, wherein said transporting means comprises means for cooling the mixture.

48. The apparatus of claim 46, wherein said transporting means comprises a vibratory conveyor.

* * * * *